US006273843B1

(12) United States Patent
Lo

(10) Patent No.: US 6,273,843 B1
(45) Date of Patent: Aug. 14, 2001

(54) WALKING EXERCISER HAVING A TREADMILL-BODY INCLINATION ADJUSTMENT MECHANISM

(76) Inventor: Peter K. C. Lo, No. 3, Ching-Cheng-Ssu St., Taichung City (TW)

( * ) Notice: Subject to any disclaimer, the term of this patent is extended or adjusted under 35 U.S.C. 154(b) by 0 days.

(21) Appl. No.: 09/636,337

(22) Filed: Aug. 10, 2000

(51) Int. Cl.[7] ..... A63B 21/00
(52) U.S. Cl. ..... 482/54; 482/51
(58) Field of Search ..... 482/54, 51, 908

(56) References Cited

U.S. PATENT DOCUMENTS 5,184,988 * 2/1993 Dunham ..... 482/54
5,626,538 * 5/1997 Dalebout et al. ..... 482/54
6,042,515 * 3/2000 Wang ..... 482/54
6,110,076 * 10/2000 Hurt ..... 482/54
6,135,925 * 10/2000 Liu ..... 482/54

* cited by examiner

*Primary Examiner*—Stephen R. Crow
(74) *Attorney, Agent, or Firm*—Trop, Pruner & Hu, P.C.

(57) ABSTRACT

A walking exerciser includes a horizontal frame and an upright frame extending uprightly from the horizontal frame, and a treadmill body attached to and disposed over the horizontal frame. An inclination adjustment mechanism includes two rear links having lower ends mounted pivotally on a rear portion of the horizontal frame and that are inclined forwardly and upwardly. Two horizontal first pivots extend through upper ends of the rear links, and connect the rear links rotatably to the treadmill body. Two front links have upper ends sleeved rotatably on the first pivots, respectively, and are inclined forwardly and downwardly. Two slots are formed in the horizontal frame. Two sliding members are fixed respectively to lower ends of the front links and are received slidably within the slide slots. A connecting member interconnects the front links fixedly. A movable tube has a rear end that is connected pivotally to the connecting member, and a front end surface that is formed with a threaded hole. A threaded rod has a rear end portion that engages threadedly the threaded hole in the tube. A second pivot extends in a direction parallel to the first pivots, and connects a front end portion of the threaded rod rotatably to the treadmill body.

5 Claims, 8 Drawing Sheets

WALKING EXERCISER HAVING A TREADMILL-BODY INCLINATION ADJUSTMENT MECHANISM

BACKGROUND OF THE INVENTION

1. Field of the Invention

The invention relates to a walking exerciser, more particularly to a walking exerciser that is provided with an inclination adjustment mechanism for adjusting inclination of a treadmill body with respect to a horizontal frame.

2. Description of the Related Art

Referring to FIG. 1, a conventional walking exerciser 10 is shown to include a base member 11 and an elongated treadmill body 12. The base member 11 includes a horizontal frame 110 with front and rear portions (111, 112), a pair of upright posts 14, 15 that are disposed on and that extend upwardly from the front portion 111 of the horizontal frame 110, and a handgrip member 16 attached to upper ends of the upright posts 14, 15. The treadmill body 12 is laid over the base member 11, and has a front portion 121 connected pivotally to the front portion 111 of the horizontal frame 110 so that the treadmill body 12 can be turned upwardly on the base member 11 to a folded position, and a rear portion 122 that abuts against the handgrip member 16 when the treadmill body 12 is rotated to the folded position.

Some of the drawbacks of the aforesaid conventional walking exerciser are as follows:

1. Inclination of the treadmill body 12 relative to the horizontal frame 110 cannot be adjusted, thereby preventing the user from conducting vigorous training, such as walking on a steep slope, on the treadmill body 12.

2. At the folded position, the treadmill body 12 is only propped against the handgrip member 16. Thus, accidental collision to the treadmill body 12 may result in falling of the same over the horizontal frame 12, thereby exposing a nearby person to the risk of injury.

SUMMARY OF THE INVENTION

Therefore, the object of this invention is to provide a walking exerciser with a treadmill-body inclination adjustment mechanism and a locking device for locking the treadmill body at the folded position so that the aforesaid drawbacks encountered during use of the conventional walking exerciser can be eliminated.

Accordingly, the walking exerciser of the present invention includes a supporting member which has a horizontal frame with front and rear portions, and an upright frame that is disposed on and that extends uprightly from the horizontal frame, a treadmill body attached to and disposed over the horizontal frame, and an inclination adjustment mechanism. The inclination adjustment mechanism includes two rear links which have upper ends, and lower ends that are mounted pivotally on the rear portion of the horizontal frame and that are inclined forwardly and upwardly. The rear links are secured to each other. Two horizontal first pivots extend respectively through the upper ends of the rear links, and are further attached to the treadmill body, thereby connecting the rear links rotatably to the treadmill body. Two front links have lower ends, and upper ends that are sleeved rotatably on the horizontal first pivots, respectively, and are inclined forwardly and downwardly. Two slide slots are formed in the supporting member, and extend rearwardly from the front portion of the horizontal frame to the rear portion of said horizontal frame. Two sliding members are fixed respectively to the lower ends of the front links, and are received respectively and slidably within the slide slots in the supporting member. A connecting member interconnects the front links fixedly. A movable tube has a rear end that is connected pivotally to the connecting member, and a front end surface that is formed with a threaded hole in the tube. A threaded rod has a rear end portion that engages threadedly the threaded hole in the tube, and a front end portion. A second pivot extends in a direction parallel to the first pivots, and through the front end portion of the threaded rod, and connects the threaded rod rotatably to the treadmill body. A drive unit is disposed on one of the supporting member and the treadmill body, and is connected operably to the threaded rod for rotating the threaded rod. When the threaded rod is rotated to move the tube relative to the threaded rod, the sliding members move within the slide slots in the supporting member so as to move the lower ends of the front links toward and away from the lower ends of the rear links, thereby adjusting inclination of the treadmill body with respect to the horizontal frame of the supporting member.

BRIEF DESCRIPTION OF THE DRAWINGS

These and other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
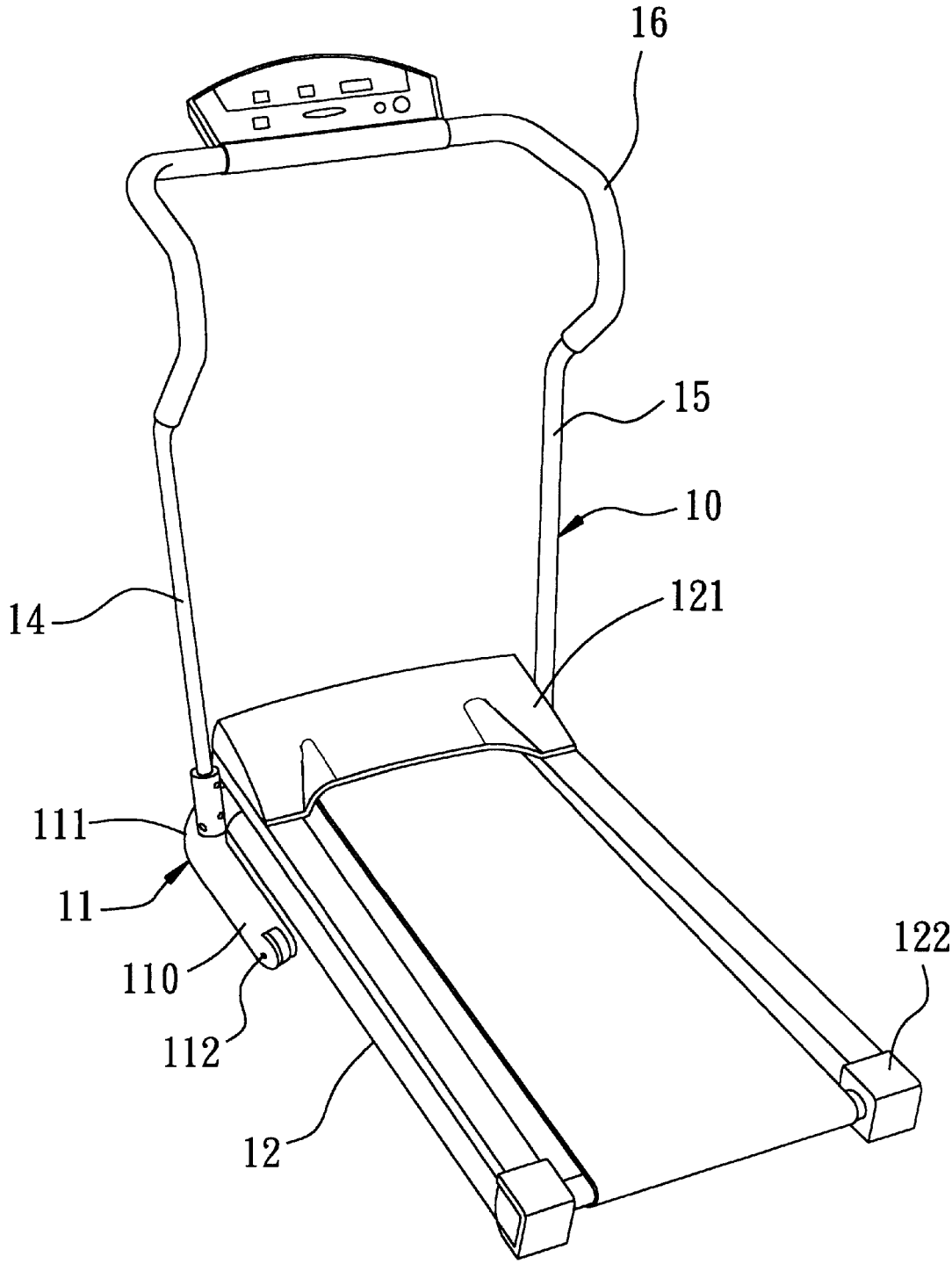
FIG. 1 PRIOR ART
FIG. 1 is a perspective view of a conventional walking exerciser.

Referring to FIGS. 2 to 6, the preferred embodiment of a walking exerciser according to this invention is shown to include a supporting member, a treadmill body 30, and an inclination adjustment mechanism 50.

As illustrated, the supporting member includes a horizontal frame 20 with front and rear portions 201, 202, and an upright frame in the form of upright posts 22, 23 which are disposed on and which extend uprightly from the front portion 201 of the horizontal frame 20.

The treadmill body 30 is attached to and is disposed over the horizontal frame 20, and has a front section 31 and a rear section 32. A running belt 40 is rotatably mounted between the front and rear sections 31, 32 of the treadmill body 30 in a known manner.

The inclination adjustment mechanism 50 includes two rear links 51, two horizontal first pivots 56, two front links 52, two slide slots 53, two sliding members 523, a connecting member 524, a movable tube 552, a threaded rod 551, a horizontal second pivot 57, and a drive unit 54. The rear links 51 are inclined forwardly and upwardly, and have upper ends 512, and lower ends 511 that are mounted pivotally on the rear portion 202 of the horizontal frame 20 via two lugs 211 (only one is visible in FIG. 3). A transverse bar 513 fastens the rear links 51 securely to each other. The first pivots 56 extend respectively through the upper ends 512 of the rear links 51, and are attached to the treadmill body 30 via two lugs 311 (only one is visible in FIG. 3), thereby connecting the rear links 51 rotatably to the treadmill body 30.

The front links 52 are inclined forwardly and downwardly, and have two lower ends 522, and two upper ends 521 that are sleeved rotatably on the first pivots 56, respectively. The slide slots 53 are formed in the supporting member, and extend rearwardly from the front portion 201 of the horizontal frame 20 to the rear portion 202 of the horizontal frame 20. The connecting member 524 interconnects the lower ends 522 of the front links 52 fixedly. The sliding members 523, such as a pair of rollers, are fixed respectively to the lower ends 522 of the front links 52, and are received respectively and slidably within the slide slots 53 in the supporting member.

The movable tube 552 has a rear end that is connected pivotally to the connecting member 524, and a front end surface that is formed with a threaded hole in the tube 552. The threaded rod 551 has a rear end portion that engages threadedly the threaded hole in the tube 552, and a front end portion. The second pivot 57 is provided to extend in a direction parallel to the first pivots 56, and passes through the front end portion of the threaded rod 551. The second pivot 57 is further attached rotatably to the treadmill body 30 via a speed reduction gear unit 542 such that the threaded rod 551 can rotate about the second pivot 57.

The drive unit 54 is disposed on the treadmill body 30, and is connected operably to the threaded rod 551 for rotating the threaded rod 551 within the movable tube 552. The drive unit 54 includes a motor 541 disposed on a transverse bar 33 of the treadmill body 30. Since the connection between the motor 541 and the speed reduction gear 542 is known in the art, and is not pertinent to the present invention, a detailed description thereof will be omitted herein for the sake of brevity.

Figure 7:
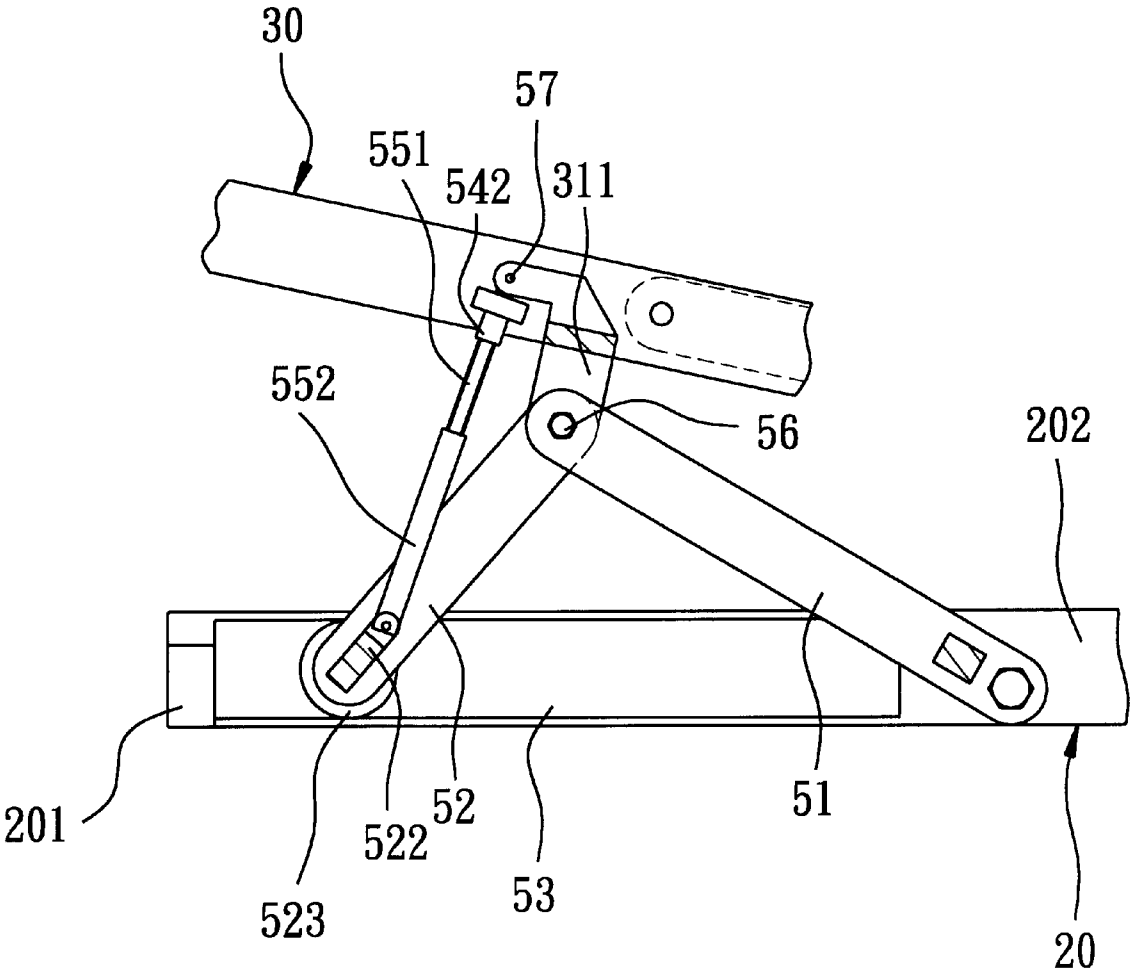
FIG. 7 is a fragmentary schematic partly sectional view of the preferred embodiment, illustrating how inclination of a treadmill body is adjusted relative to a horizontal frame.

As best shown in FIG. 7, when the threaded rod 551 is rotated to move the tube 552 relative to the threaded rod 551, the sliding members 523 move within the slide slots 53 in the supporting member so as to move the lower ends of the front links 52 toward and away from the lower ends of the rear links 51, thereby adjusting inclination of the treadmill body 30 with respect to the horizontal frame 20.

Figure 4:
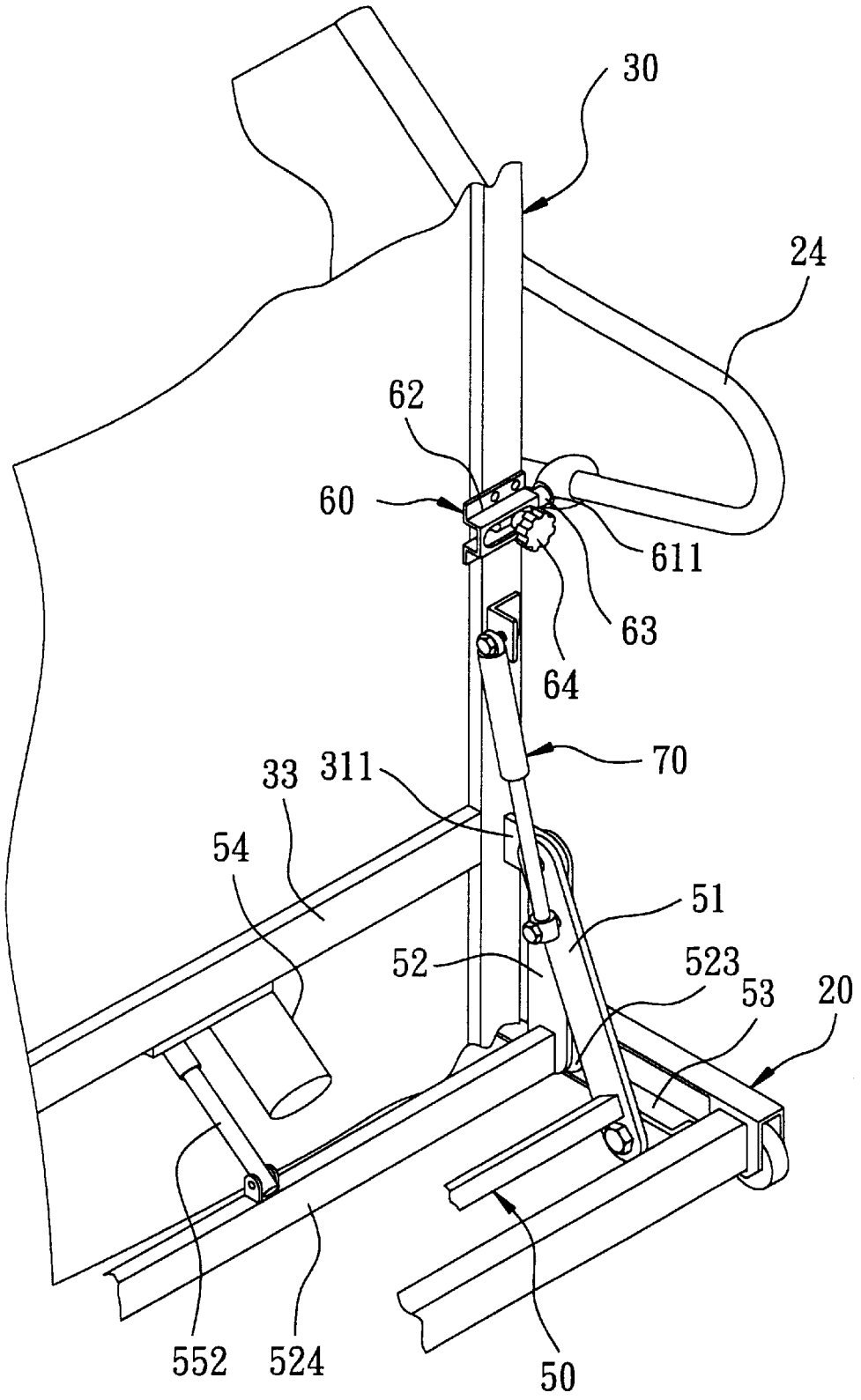
FIG. 4 is a fragmentary perspective view of the preferred embodiment shown in FIG. 2 at a folded position.
Figure 5:
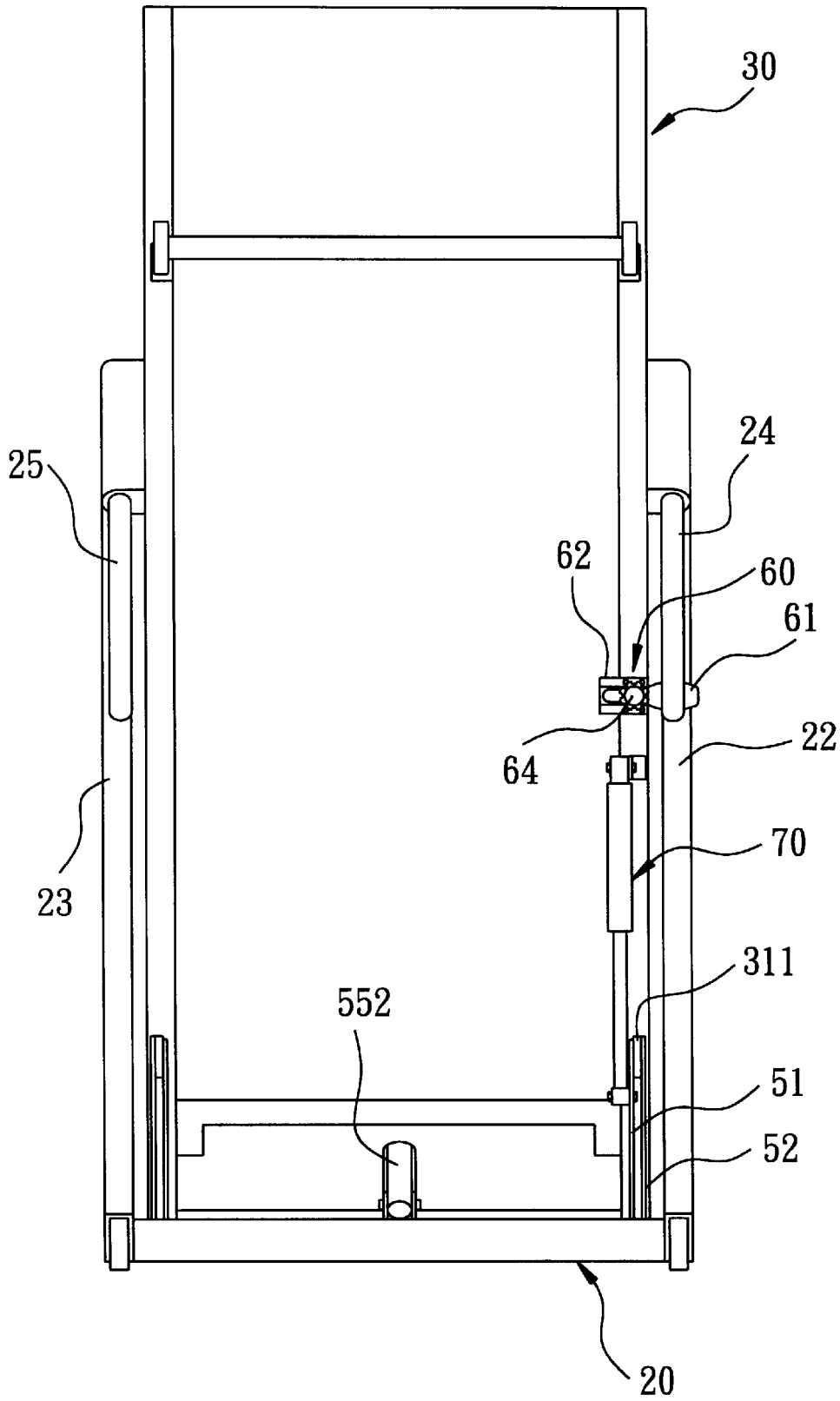
FIG. 5 is an elevational view of the preferred embodiment at the folded position.
Figure 6:
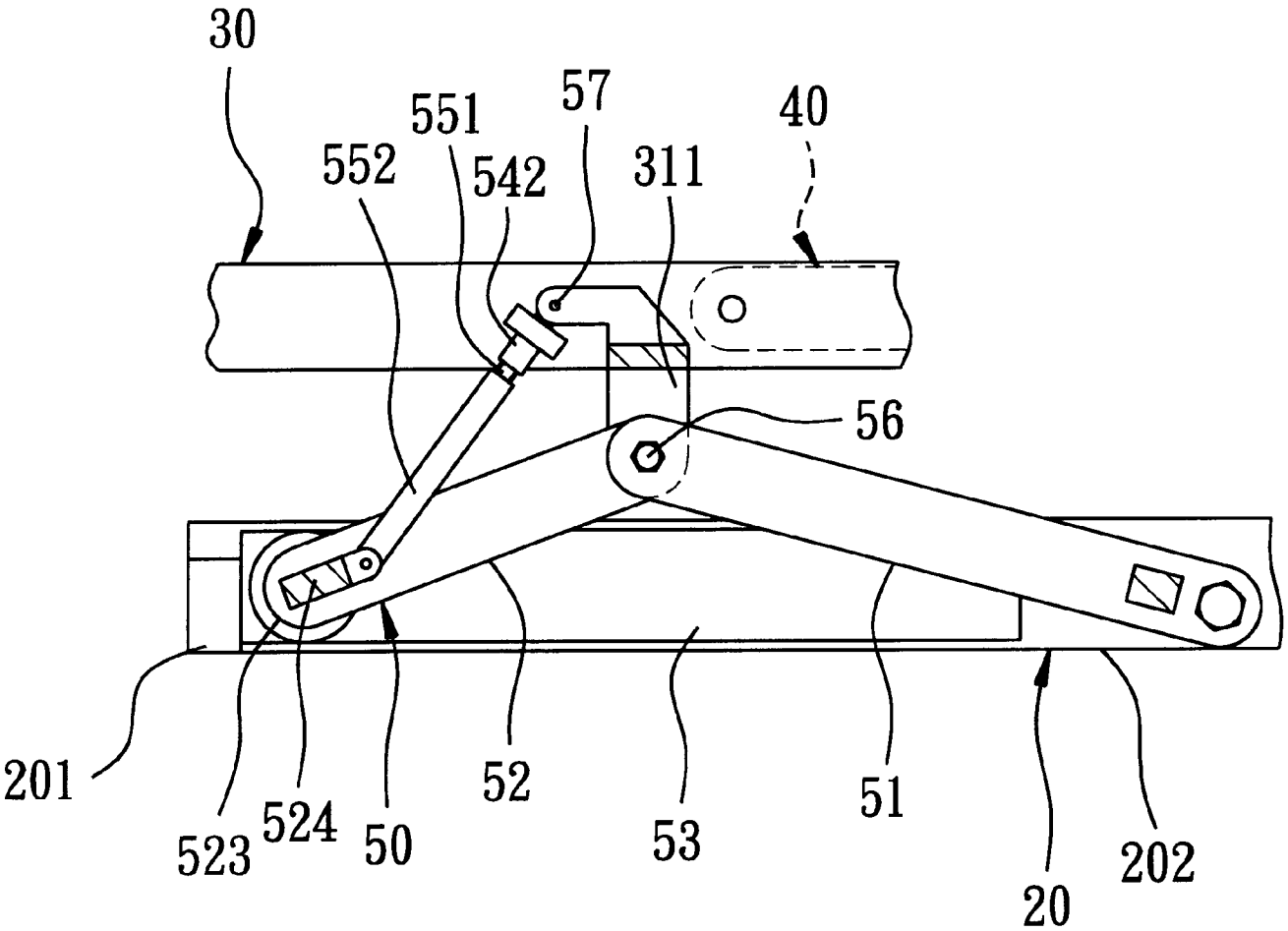
FIG. 6 is a fragmentary schematic partly sectional view of the preferred embodiment shown in FIG. 2.

When the walking exerciser of the present invention is not in use, a manual upward lift on the rear section 32 of the treadmill body 30 (see FIG. 2) will result in folding of the treadmill body 30 on the upright posts 22,23 (see FIG. 2), as best shown in FIG. 4.

Figure 2:
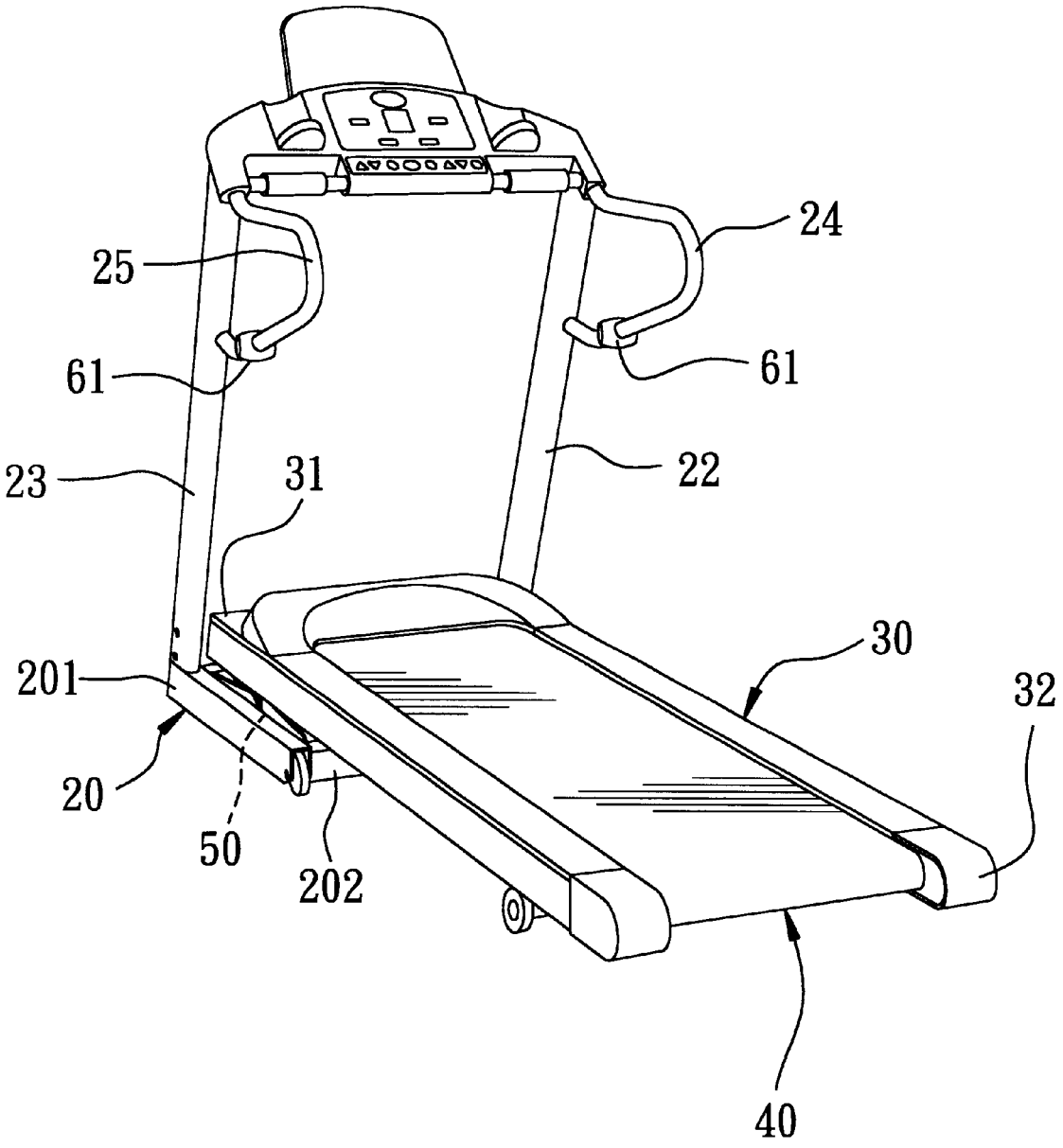
FIG. 2 is a perspective view of a preferred embodiment of a walking exerciser according to the present invention.
Figure 3:
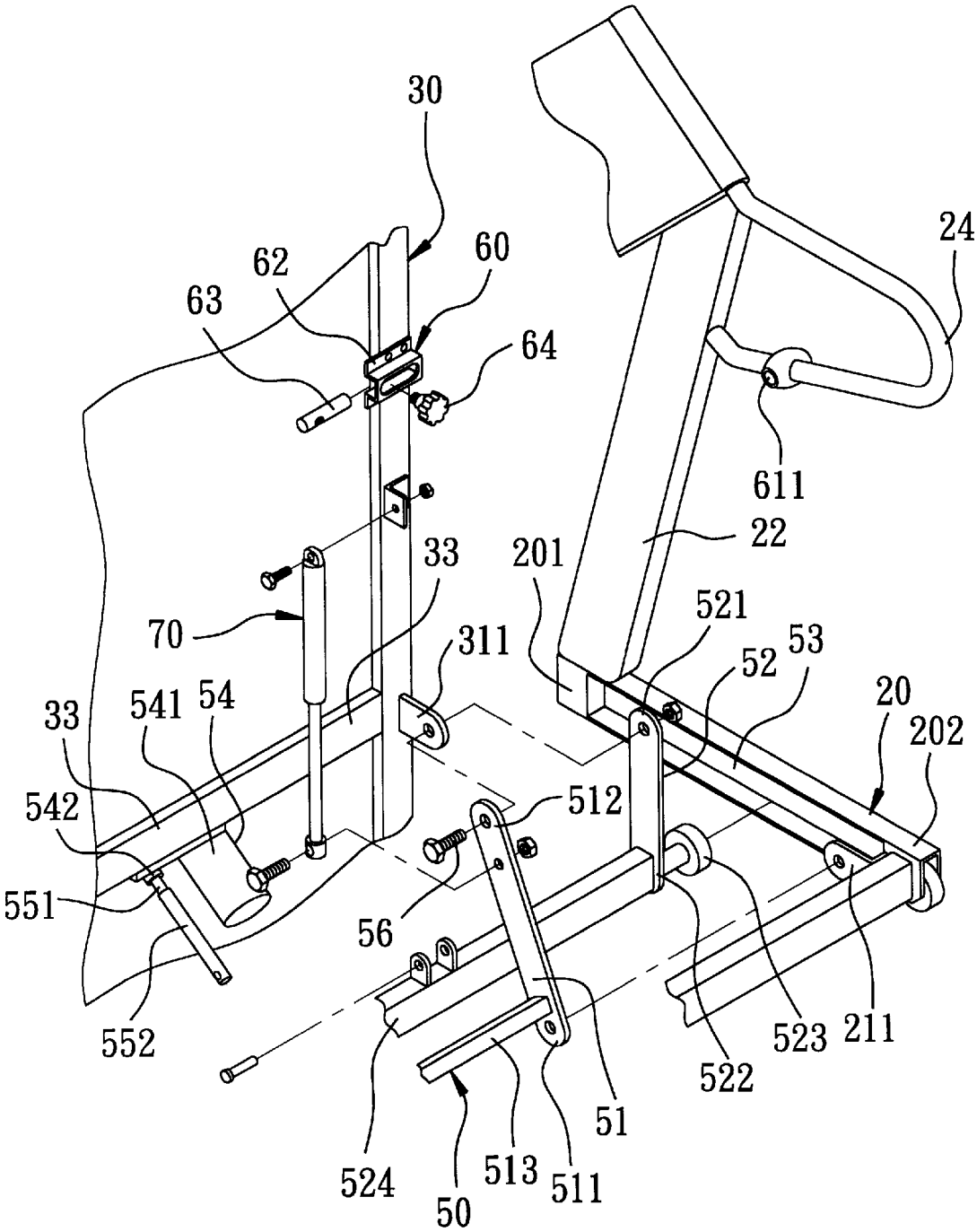
FIG. 3 is a partly exploded fragmentary view of the preferred embodiment.

Referring to FIGS. 2 and 3, a locking device 60 is provided for locking the treadmill body 30 to the upright posts 22,23 when the treadmill body 30 is at the folded position. The locking device 60 includes a latch hole 611 formed in a handgrip member 24 that is fixed on the upright post 22, a latch casing 62 fixed on the treadmill body 30, and a latch member 63 disposed movably in the latch casing 62. An operating knob 64 extends through the latch casing 62, and is fastened securely on the latch member 63. The latch member 63 is movable to engage the latch hole 611, when the treadmill body 30 is folded manually on the upright posts 22,23, thereby locking the treadmill body 30 on the upright post 22.

Figure 8:
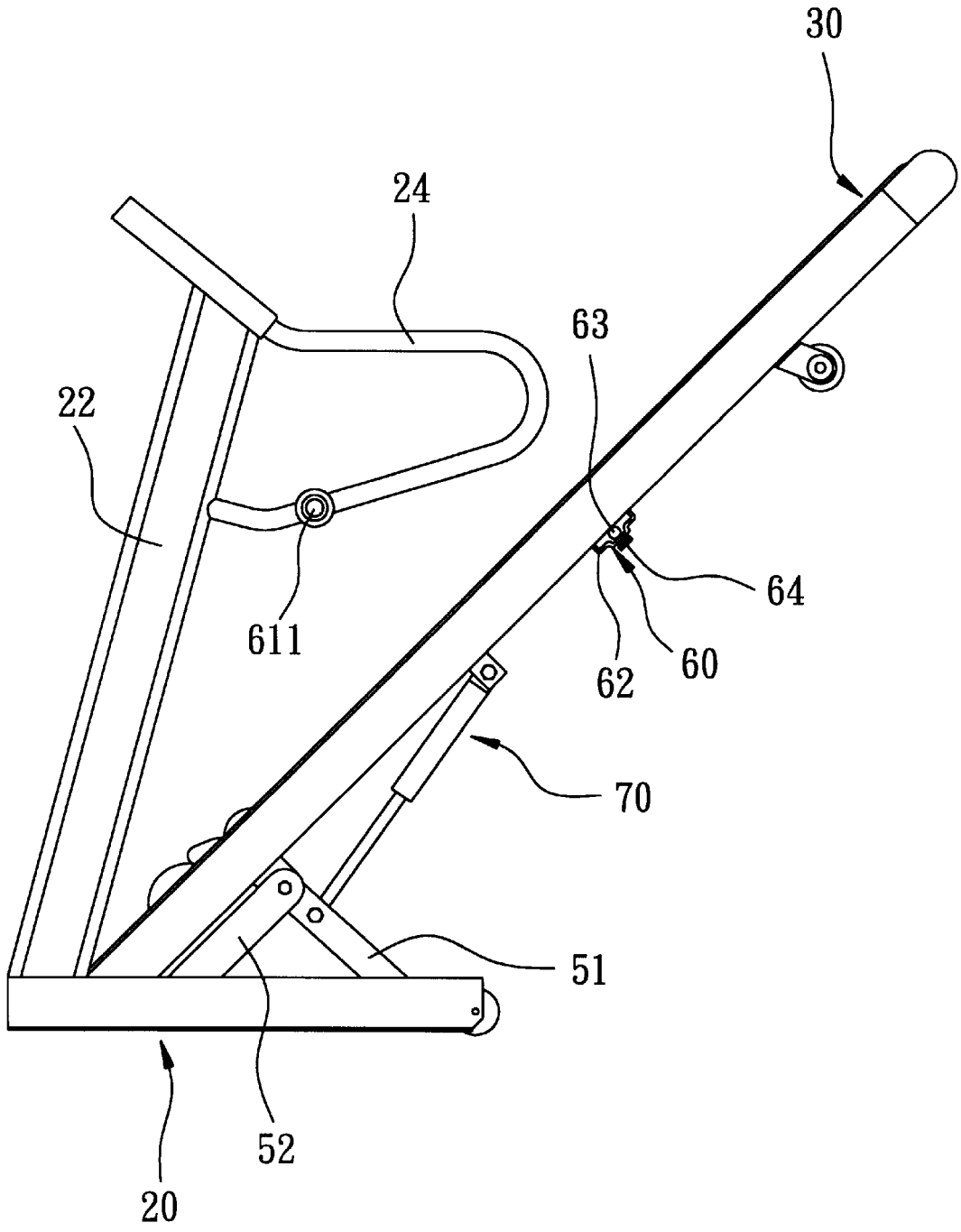
FIG. 8 is a side view of the preferred embodiment, illustrating how movement of the treadmill body is retarded during its descent on the horizontal frame.

Referring to FIG. 8, a damping cylinder 70 is disposed between the treadmill body 30 and the horizontal frame 20 of the supporting member, thereby retarding relative movement therebetween. A known hydraulic cylinder can be employed as the damping cylinder 70 in the preferred embodiment, such that when the latch member 63 disengages the latch hole 611, a downward pull on the treadmill body 30 by the user will result in slow descent of the treadmill body 30 on the horizontal frame 20.

Some of the advantages provided by the walking exerciser of the present invention are as follows:

1. Inclination of the treadmill body 30 relative to the horizontal frame 20 can adjusted in order to provide a required slope surface such that vigorous walking exercise can be performed on the treadmill body 30.

2. Since the treadmill body 30 can be locked at the folded position by the locking device 60, injuries due to falling of the treadmill body 30 over the horizontal frame 20 can be avoided.

With this invention thus explained, it is apparent that numerous modifications and variations can be made without departing from the scope and spirit of this invention. It is therefore intended that this invention be limited only as indicated by the appended claims.

I claim:

1. A walking exerciser comprising:

a supporting member including a horizontal frame with front and rear portions, and an upright frame disposed on and extending uprightly from said horizontal frame;

a treadmill body attached to and disposed over said horizontal frame, and having a front section and a rear section; and an inclination adjustment mechanism including two rear links which have upper ends, and lower ends that are mounted pivotally on said rear portion of said horizontal frame and that are inclined forwardly and upwardly, said rear links being secured to each other, two horizontal first pivots extending through said upper ends of said rear links and attached to said treadmill body, thereby connecting said rear links rotatably to said treadmill body, two front links which have lower ends, and upper ends that are sleeved rotatably on said horizontal first pivots, respectively, and that are inclined forwardly and downwardly, two slide slots formed in said supporting member and extending rearwardly from said front portion of said horizontal frame to said rear portion of said horizontal frame, two sliding members fixed respectively to said lower ends of said front links and received respectively and slidably within said slide slots in said supporting member, a connecting member interconnecting said front links fixedly, a movable tube having a rear end that is connected pivotally to said connecting member, and a front end surface that is formed with a threaded hole in said tube, a threaded rod which has a rear end portion that engages threadedly said threaded hole in said tube, and a front end portion, a horizontal second pivot disposed to extend in a direction parallel to said first pivots, said second pivot passing through said front end portion of said threaded rod and connecting said threaded rod rotatably to said treadmill body such that said treadmill body can be folded manually on said upright frame, and a drive unit disposed on one of said supporting member and said treadmill body and connected operably to said threaded rod for rotating said threaded rod; and whereby, when said threaded rod is rotated to move said tube relative to said threaded rod, said sliding members move within said slide slots in said supporting member so as to move said lower ends of said front links toward and away from said lower ends of said rear links, thereby adjusting inclination of said treadmill body with respect to said horizontal frame of said supporting member.

2. The walking exerciser as defined in claim 1, wherein said sliding members are rollers.

3. The walking exerciser as defined in claim 1, wherein said drive unit includes a motor that is disposed on said treadmill body, and a reduction gear that connects said motor to said front end portion of said threaded rod.

4. The walking exerciser as defined in claim 1, further comprising a locking device which includes:

a latch hole formed in said upright frame of said supporting member; and a latch member disposed movably on said treadmill body and movable to engage said latch hole in said upright frame when said treadmill body is folded on said upright frame, thereby locking said treadmill body on said supporting member.

5. The walking exerciser as defined in claim 4, further comprising a damping cylinder which is disposed between said treadmill body and said horizontal frame of said supporting member, thereby retarding relative movement therebetween.

* * * * *